US007079794B2

(12) United States Patent
Forbes, II et al.

(10) Patent No.: US 7,079,794 B2
(45) Date of Patent: Jul. 18, 2006

(54) MATERIAL STATE MANAGEMENT VIA AUTOMATIC TONER PURGE

(75) Inventors: Richard L. Forbes, II, Pittsford, NY (US); Mark A. Scheuer, Williamson, NY (US); Joseph A. Mastrandrea, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/741,715

(22) Filed: Dec. 19, 2003

(65) Prior Publication Data

US 2004/0170442 A1 Sep. 2, 2004

Related U.S. Application Data

(60) Provisional application No. 60/451,360, filed on Feb. 28, 2003.

(51) Int. Cl.
*G03G 15/08* (2006.01)

(52) U.S. Cl. ..... 399/257; 399/27; 399/29

(58) Field of Classification Search ..... 399/24–27, 399/29, 31, 34, 35, 72, 79, 253, 254, 257
See application file for complete search history.

(56) References Cited

U.S. PATENT DOCUMENTS

| | | | | |
|---|---|---|---|---|
| 5,512,981 | A * | 4/1996 | Hirsch | 399/49 |
| 5,724,627 | A | 3/1998 | Okuno et al. | |
| 6,047,142 | A | 4/2000 | Donaldson | |
| 6,167,213 | A | 12/2000 | Buranicz et al. | |
| 6,766,121 | B1 * | 7/2004 | Nonaka et al. | 399/24 |
| 2003/0228159 | A1 | 12/2003 | Tungate et al. | |

* cited by examiner

*Primary Examiner*—Hoang Ngo
(74) *Attorney, Agent, or Firm*—William Eipert

(57) ABSTRACT

A method for operating a printing machine to maintain developer material within in a predefined state by monitoring the state of materials in a developer and automatically scheduling corrective action before print quality becomes significantly impacted. The corrective action can include forcing an increase in toner usage by periodically generating and developing images having high toner density.

7 Claims, 7 Drawing Sheets

MATERIAL STATE MANAGEMENT VIA AUTOMATIC TONER PURGE

This application is based on and, to the fullest extent possible, claims priority from Provisional Patent Application No. 60/451,360, filed Feb. 28, 2003. Furthermore, cross reference is made to the related U.S. patent application entitled "Method for Controlling the State of Developer Material," to Richard L. Forbes, II et al., application Ser. No. 10/741,568 filed Dec. 19, 2003.

The present disclosure relates generally to a method for operating in a printing device. More particularly, the teachings herein are directed to an apparatus and method for maintaining material in a developer housing within a predefined state.

Generally, the process of electrostatographic printing includes the step of charging an imaging member to a substantially uniform potential to sensitize the surface thereof. A latent image is generated on the charged portion of the surface of the imaging member by, in electrophotographic printing, exposure to a light image from, for example, an original document being reproduced, a scanning laser beam, an LED source, etc. or, in electron beam imaging and ion deposition printing, deposition of charges on the imaging medium. The recorded latent image is then developed by bringing a developer material into contact therewith. This forms a toner powder image on the imaging member that is subsequently transferred to a substrate, such as paper. Finally, the toner powder image is permanently affixed to the substrate in image configuration, for example by heating and/or pressing the toner powder image.

A common goal in the design and development of electrostatographic printing devices is the ability to maintain optimum image quality from page to page and job to job regardless of the characteristics of the images being formed on each page. As should be appreciated, to maintain optimum image quality it is important that the printing device sustain good development as well as good transfer efficiency. Good development or good developability, refers to the ability of the device to transfer the appropriate amount of toner to the latent image when forming the toner powder image. Good transfer efficiency refers to the ability of the printing device to transfer the toner powder image to the substrate.

It is known that maintaining the state of the material in the developer housing within an optimum range improves developability and transfer efficiency. To accomplish this, many printing systems use a variety of processes to maintain the state of the developer materials within the optimum range by monitoring and controlling one or more characteristics of the materials including, for example, temperature, humidity, charge, toner concentration (ratio of toner to carrier) and toner charge distribution.

However, even if the developer materials are maintained in an optimal state it has been observed that when running low area coverage jobs the developability and/or transfer efficiency can fall off due to changes in the materials state in the developer housing. This fall off in developability and/or transfer efficiency produces weak, mottled and/or streaky images and can cause the process controls to use all of the printer's operating space in trying to correct the problems. With existing printing devices, when running low area coverage jobs and a reduced image quality suspected to result from a fall off in developability or transfer efficiency is observed, it is known to address the problem by either changing the materials within the developer housing(s) or by running a large number of prints (e.g., 1–2 thousand) of a high area coverage document to remove "bad" toner from the developer housings.

Although replacing the materials within developer housing and/or running a large number of a high area coverage document can improve the developability and transfer efficiency and thus restore image quality, such procedures are both costly and time consuming as the user is forced to interrupt the job and perform some service action on the printer. Additionally, the above processes can result in a substantial waste of toner, carrier and/or paper resources. Furthermore, as the problem must first be identified and diagnosed by an operator before any corrective action can be taken, there is the possibility of a substantial loss in productivity resulting from the loss of a large number of pages before detection of a problem or from dedicating an operator to monitor the job to detect potential problems.

Running with a minimum throughput of area coverage is sufficient to maintain the state of the developer material package, but there is no guarantee that the images being printed will use the minimum toner from each active development station. Requiring a user to submit jobs to ensure that the minimum area coverage for each active development station places a significant burden on the user to ensure the minimum area coverage is met. Additionally, such requirement wastes toner and machine resources.

In accordance with one or more aspects of the teachings herein, there is disclosed a method for directly or indirectly monitoring the state materials in a developer and automatically scheduling corrective action before print quality becomes significantly impacted.

In accordance with one or more aspects of the teachings herein, there is disclosed a method for operating a printing machine to maintain developer material within in a predefined state, comprising developing an image to thereby provide increased toner usage and repeating the developing step until an efficacious amount of toner to maintain the developer material within in the predefined state has been used.

In accordance with one or more aspects of the teachings herein, there is disclosed a method for operating a printing machine to maintain developer material within in a predefined state including monitoring health of the material in the developer housing and forcing an increase in toner usage in response to a diagnosis of toner health. The forced increase in toner usage can take many forms. For example, the use may comprise developing an image or patch between the development of images generated in response to image data provided by a user. Additionally, the use may suspending development of images generated in response to image data provided by a user and then developing images having toner usage. Furthermore, the forced use can comprise directly removing toner form the developer housing.

In accordance with one or more aspects of the teachings herein, there is disclosed a method for operating a printing machine having a plurality of developer stations to maintain developer material within in a predefined state. The method includes monitoring developer material health at each developer station within the plurality of developer stations to detect unhealthy developer material; upon detecting unhealthy developer material in at least one of developer stations, configuring a toner purge; and performing the toner purge.

The teachings and embodiments disclosed herein will be described with reference to the accompanying drawings, which are provided for purposes of illustrating various aspects of the teachings and embodiments and are not to be construed as limiting the same, wherein.

Figure 1:
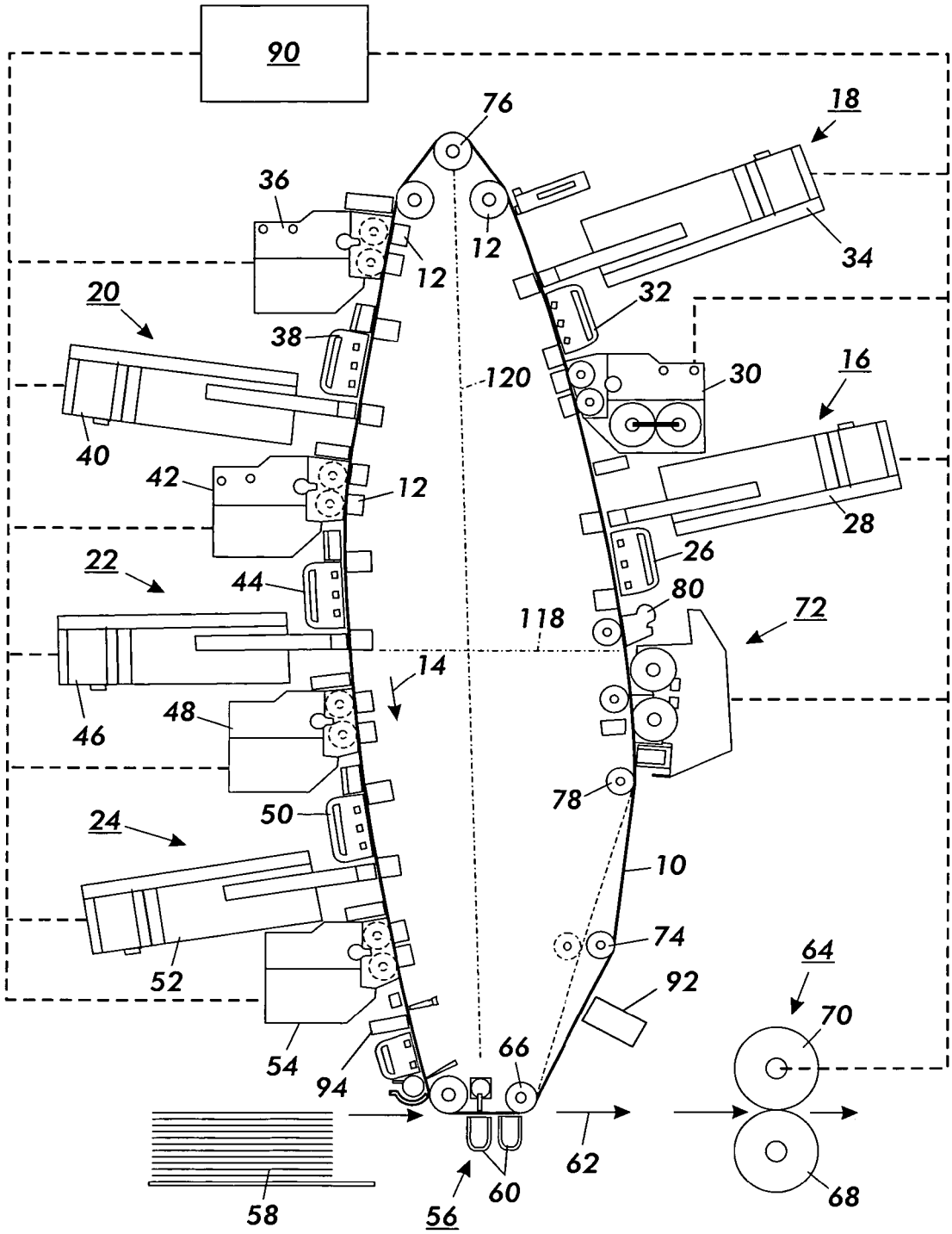
FIG. 1 is a schematic diagram of a multi-color printing machine which may incorporate one or more aspects of the embodiments disclosed herein.

Turning to FIG. 1, there is shown a single pass multi-color printing machine that may incorporate one or more features of the teachings herein. The printing machine employs a photoconductive belt 10, supported by a plurality of rollers or bars, 12. Photoconductive belt 10 advances in the direction of arrow 14 to move successive portions of the external surface of photoconductive belt 10 sequentially beneath the various processing stations disposed about the path of movement thereof. The printing machine architecture includes five image recording stations indicated generally by the reference numerals 16, 18, 20, 22, and 24, respectively.

Initially, photoconductive belt 10 passes through image recording station 16. Image recording station 16 includes charging device 26 and exposure device 28. Charging device 26 includes a corona generator or similar device that charges the exterior surface of photoconductive belt 10 to a substantially uniform potential. After the exterior surface of photoconductive belt 10 is charged, the charged portion thereof advances to the exposure device 28. The exposure device includes a raster output scanner (ROS), which illuminates the charged portion of the exterior surface of photoconductive belt 10 to record a first electrostatic latent image thereon. Alternatively, a light emitting diode (LED) may be used.

This first electrostatic latent image is developed by developer unit 30. Developer unit 30 deposits toner particles of a selected color on the first electrostatic latent image. After the first toner powder image has been developed on the exterior surface of photoconductive belt 10, belt 10 continues to advance in the direction of arrow 14 to image recording station 18.

Image recording station 18 includes a charging device 32 and an exposure device 34. Here again, the charging device includes a corona generator or the like which recharges-the exterior surface of photoconductive belt 10 to a substantially uniform potential. Exposure device 34 includes a ROS which illuminates the charged portion of the exterior surface of photoconductive belt 10 selectively to record a second electrostatic latent image thereon. This second electrostatic latent image corresponds to the regions to be developed with a second color toner particles. This second electrostatic latent image is now advanced to the next successive developer unit 36.

Developer unit 36 deposits the second color toner particles on the electrostatic latent image. In this way, a second color toner powder image is formed on the exterior surface of photoconductive belt 10. This second color toner powder image may be partially in superimposed registration with the previously formed powder image. After the second color toner powder image has been developed on the exterior surface of photoconductive belt 10, photoconductive belt 10 continues to advance in the direction of arrow 14 to image recording station 20.

Image recording station 20 includes a charging device 38 and an exposure device 40. Charging device 38 recharges the photoconductive surface to a substantially uniform potential. Exposure device 40 illuminates the charged portion of the exterior surface of photoconductive belt 10 to selectively dissipate the charge thereon to record a third electrostatic latent image corresponding to the regions to be developed with toner particles of a third color. This third electrostatic latent image is now advanced to the next successive developer unit 42. Developer unit 42 deposits the third color toner particles on the exterior surface of photoconductive belt 10 to form a toner powder image thereon. This third toner powder image may be partially in superimposed registration with one or more of the previously formed powder images. After the third electrostatic latent image has been developed, photoconductive belt 10 advances in the direction of arrow 14 to the next image recording station 22.

Image recording station 22 includes a charging device 44 and an exposure device 46. Charging device 44 recharges the exterior surface of photoconductive belt 10 to a substantially uniform potential and exposure device 46 illuminates the charged portion of the exterior surface of photoconductive belt 10 to selectively dissipate the charge on the exterior surface of photoconductive belt 10 to record a fourth electrostatic latent image for development with toner particles of a fourth color. After the fourth electrostatic latent image is recorded on the exterior surface of photoconductive belt 10, photoconductive belt 10 advances this electrostatic latent image to developer unit 48.

Developer unit 48 deposits toner particles on the fourth electrostatic latent image. These toner particles may be partially in superimposed registration with one or more of the previously formed powder images. After the fourth toner powder image is formed on the exterior surface of photoconductive belt 10, photoconductive belt 10 advances to the next image recording station 24.

Image recording station 24 includes a charging device 50 and an exposure device 52. The charging device recharges the exterior surface of photoconductive belt 10 to a relatively high, substantially uniform potential. The exposure device illuminates the charged portion of the exterior surface of photoconductive belt 10 to selectively discharge those portions of the charged exterior surface of photoconductive belt 10 which are to be developed with toner particles of a fifth color. The fifth electrostatic latent image is then advanced to developer unit 54.

At developer unit 54, toner particles are deposited on the exterior surface of photoconductive belt 10. These toner particles form a toner powder image of a fifth color which may be partially or totally in superimposed registration with the previously formed toner powder images. In this way, a multi-color toner powder image is formed on the exterior surface of photoconductive belt 10. Thereafter, photoconductive belt 10 advances the multi-color toner powder image to a transfer station, indicated generally by the reference numeral 56.

In one embodiment, the colors of the first, second, third, fourth and fifth toner images are a highlight or specialty color, magenta, yellow, cyan, and black, respectively; however, other colors may be substituted. Furthermore, one skilled in the art will readily recognize that the order of the colors may vary based upon the operating properties of the printing machine.

At transfer station 56, a receiving medium, e.g., paper, is advanced from stack 58 by sheet feeders and guided to transfer station 56. At transfer station 56, corona generating device 60 sprays ions onto the backside of the paper. This attracts the developed multi-color toner image from the exterior surface of photoconductive belt 10 to the sheet of paper. Stripping assist roller 66 contacts the interior surface of photoconductive belt 10 and provides a sufficiently sharp bend thereat so that the beam strength of the advancing paper strips from photoconductive belt 10. A vacuum transport moves the sheet of paper in the direction of arrow 62 to fusing station 64.

Fusing station 64 includes a heated fuser roller 70 and a back-up roller 68. The back-up roller 68 is resiliently urged into engagement with the fuser roller 70 to form a nip through which the sheet of paper passes. In the fusing operation, the toner particles coalesce with one another and bond to the sheet in image configuration, forming a multi-color image thereon. After fusing, the finished sheet is discharged to a finishing station where the sheets are compiled and formed into sets which may be bound to one another. These sets are then advanced to a catch tray for subsequent removal therefrom by the printing machine operator.

One skilled in the art will appreciate that while the multi-color developed image has been disclosed as being transferred to paper, it may be transferred to an intermediate member, such as a belt or drum, and then subsequently transferred and fused to the paper. Furthermore, while toner powder images and toner particles have been disclosed herein, one skilled in the art will appreciate that a liquid developer material employing toner particles in a liquid carrier may also be used.

Invariably, after the multi-color toner powder image has been transferred to the sheet of paper, residual toner particles remain adhering to the exterior surface of photoconductive belt 10. The photoconductive belt 10 moves over isolation roller 78 which isolates the cleaning operation at cleaning station 72. At cleaning station 72, the residual toner particles are removed from photoconductive belt 10. Photoconductive belt 10 then moves under spots blade 80 to also remove toner particles therefrom.

System controller 90 communicates with, controls and coordinates interactions between the various systems and subsystems within the machine to maintain the operation of the printing machine. That is, the system controller has a system-wide view and can monitor and adjust the operation of each subsystem affected by changing conditions and changes in other subsystems. The system controller can also perform numerous higher level functions. For example, system controller 90 can perform reliability assurance functions including recognizing errors within systems and inform an operator if a failure has occurred. System controller 90 can also be employed to maintain a history of system and subsystem performance relative to the setpoints to develop an understanding of the evolution of the individual systems and subsystems to diagnose more subtle print machine failure modes. System controller 90 can further be used to detect consistent failures of one or more process controls systems and in response, initiate more sophisticated diagnostic tools such as failure prediction and graceful recovery processes using decision making techniques such as fuzzy logic, neural nets, sensor fusion, genetic algorithms, etc. In addition, the controls supervisor can determine appropriate tradeoffs between the subsystems to maintain system output within specified limits and to prolong the life of the IOT subsystems.

Although shown as a single block in FIG. 1, it should be appreciated that system controller 90 may comprise a plurality of controller/processing devices and associated memory distributed throughout the printing device employing, for example, a hierarchical process controls architecture. In a hierarchical architecture, system controller 90 may include various levels of controllers or processors. The lowest level controllers can be used to stabilize the operation locally within a subsystem (e.g., component level) by using data output from one or more sensors provided for the subsystem along with a control algorithm to directly adjust or operate an actuator for the subsystem. Higher level controllers can be used to respond to information from one or more lower level controllers and/or sensor readings to actuate or adjust one or more parameters for at least one low-level controller. Additionally, higher level controllers can monitor the performance of the lower level controllers and adjust the individual and inter-related behavior of one or more of the lower level controllers to respond to a number of varying conditions affecting print quality. Additionally, higher level controllers can coordinate actions between lower level controllers.

That is, higher level controllers may arbitrate the recommended actions from the lower level controllers and maintain setpoints for the lower level controllers within the limits dictated by latitudes of the system or subsystem. As changes in one subsystem can affect the remaining subsystems, the higher level controllers rely on information provided by other controllers and other factors to accurately maintain printer performance. The higher level controllers may also monitor processing logs of lower level controller to determine if there is valid data for each of the controllers and use this information to resolve conflicts among the lower level controllers. The higher level controllers may also perform a scheduling function by scheduling the actions or operation of the lower level controllers. Although a description of a distributed system having a hierarchical architecture has been provided, it should be appreciated that system controller 90 can employ any conventional or commonly used system or technique for controlling a print machine.

Figure 2:
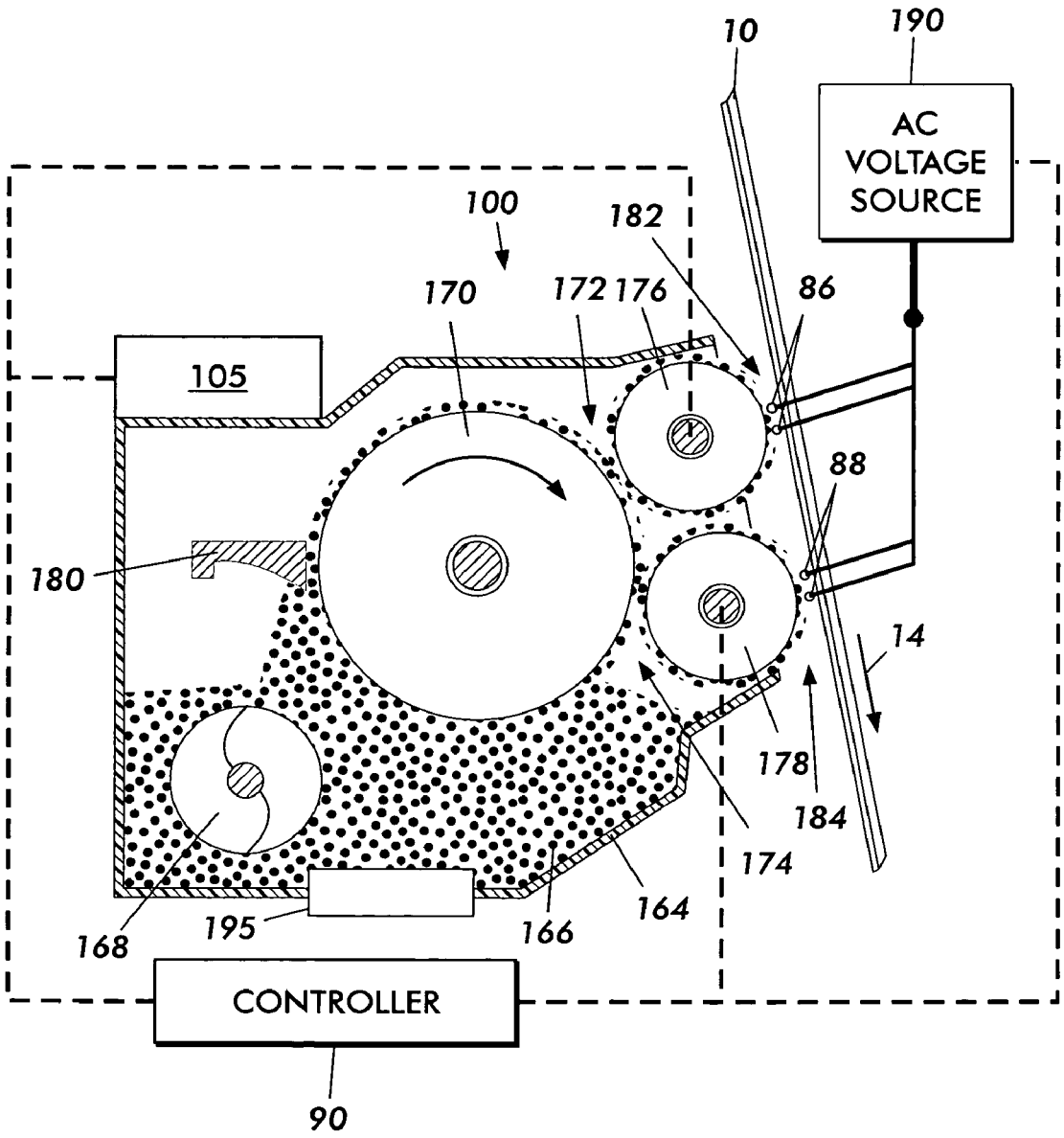
FIG. 2 is drawing illustrating details of an Hybrid scavengeless development (HSD) developer apparatus.

Referring now to FIG. 2, there are shown the details of an Hybrid scavengeless development (HSD) developer apparatus 100. Briefly reviewing, HSD technology deposits toner onto the surface of a donor roll via a conventional magnetic brush. The donor roll generally consists of a conductive core covered with a thin (50–200 micron) partially conductive layer. The magnetic brush roll is held at an electrical potential difference relative to the donor core to produce the field necessary for toner development. Applying an AC voltage to one or more electrode wires spaced between the donor roll and the imaging belt provides an electric field which is effective in detaching toner from the surface of the donor roll to produce and sustain an agitated cloud of toner particles about the wires, the height of the cloud being such as not to be substantially in contact with the belt. Typical AC voltages of the wires relative to the donor are 700–900 Vpp at frequencies of 5–15 kHz and may be applied as square waves, rather than pure sinusoidal waves. Toner from the cloud is then developed onto the nearby photoreceptor by fields created by a latent image. However, in another embodiment of the hybrid system, the electrode wires may be absent. For example, a hybrid jumping development system may be used wherein an AC voltage is applied to the donor roll, causing toner to be detached from the donor roll and projected towards the imaging member surface.

Continuing with FIG. 2, apparatus 100 comprises a reservoir 164 containing developer material 166. The developer material may be either of the one component or two component type. For purposes of discussion, developer material 166 is of the two component type, that is it comprises carrier granules and toner particles; however, it should be appreciated that single component developer may also be used. The two-component developer material 166 may be of any suitable type. The use of an electrically conductive developer can eliminate the possibility of charge build-up within the developer material on the magnetic brush roll which, in turn, could adversely affect development at the second donor roll. In one embodiment, the two-component developer consists of 5–15 micron insulating toner particles, which are mixed with 50–100 micron conductive magnetic carrier granules such that the developer material comprises from about 90% to about 99% by weight of carrier and from 10% to about 1% by weight of toner. By way of example, the carrier granules of the developer material may include a ferromagnetic core having a thin layer of magnetite overcoated with a non-continuous layer of resinous material. The toner particles may be made from a resinous material, such as a vinyl polymer, mixed with a coloring material.

The reservoir includes augers, indicated at 168, which are rotatably-mounted in the reservoir chamber. Augers 168 serve to transport and to agitate the material within the reservoir and encourage the toner particles to charge and adhere triboelectrically to the carrier granules. Magnetic brush roll 170 transports developer material 166 from the reservoir to loading nips 172, 174 of donor rolls 176, 178. Magnetic brush rolls are well known, so the construction of roll 170 need not be described in great detail. Briefly the roll comprises a rotatable tubular housing within which is located a stationary magnetic cylinder having a plurality of magnetic poles impressed around its surface. The carrier granules of the developer material are magnetic and, as the tubular housing of the roll 170 rotates, the granules (with toner particles adhering triboelectrically thereto) are attracted to the roll 170 and are conveyed to the donor roll loading nips 172, 174. Metering blade 180 removes excess developer material from the magnetic brush roll and ensures an even depth of coverage with developer material before arrival at the first donor roll loading nip 172.

At each of the donor roll loading nips 172, 174, toner particles are transferred from the magnetic brush roll 170 to the respective donor roll 176, 178. The carrier granules and any toner particles that remain on the magnetic brush roll 170 are returned to the reservoir 164 as the magnetic brush continues to rotate. The relative amounts of toner transferred from the magnetic roll 170 to the donor rolls 176, 178 can be adjusted, for example by: applying different bias voltages to the donor rolls; adjusting the magnetic to donor roll spacing; adjusting the strength and shape of the magnetic field at the loading nips and/or adjusting the speeds of the donor rolls.

Each donor roll transports the toner to a respective development zone 182, 184 through which the photoconductive belt 10 passes. At each of the development zones 182, 184, toner is transferred from the respective donor roll 176, 178 to the latent image on the belt 10 to form a toner powder image on the latter. Various methods of achieving an adequate transfer of toner from a donor roll to a latent image on a imaging surface are known and any of those may be employed at the development zones 182, 184. Transfer of toner from the magnetic brush roll 170 to the donor rolls 176, 178 can be encouraged by, for example, the application of a suitable D.C. electrical bias to the magnetic brush and/or donor rolls. The D.C. bias (for example, approximately 70 V applied to the magnetic roll) establishes an electrostatic field between the donor roll and magnetic brush rolls, which causes toner particles to be attracted to the donor roll from the carrier granules on the magnetic roll.

In the device of FIG. 2, each of the development zones 182, 184 is shown as having a pair of electrode wires 186, 188 disposed in the space between each donor roll 176, 178 and belt 10. The electrode wires may be made from thin (for example, 50 to 100 micron diameter) stainless steel wires closely spaced from the respective donor roll. The wires are self-spaced from the donor rolls by the thickness of the toner on the donor rolls and may be within the range from about 5 micron to about 20 micron (typically about 10 micron) or the thickness of the toner layer on the donor roll.

For each of the donor rolls 176 and 178, the respective electrode wires 186 and 188 extend in a direction substantially parallel to the longitudinal axis of the donor roll. An alternating electrical bias is applied to the electrode wires by an AC voltage source 190. The applied AC establishes an alternating electrostatic field between each pair of wires and the respective donor roll, which is effective in detaching toner from the surface of the donor roll and forming a toner cloud about the wires, the height of the cloud being such as not to be substantially in contact with belt 10. The magnitude of the AC voltage in the order of 200 to 500 volts peak at frequency ranging from about 8 kHz to about 16 kHz. A DC bias supply (not shown) applied to each donor roll 176, 178 establishes electrostatic fields between the photoconductive belt 10 and donor rolls for attracting the detached toner particles from the clouds surrounding the wires to the latent image recorded on the photoconductive surface of the belt.

After development, excess toner may be stripped from donor rolls 176 and 178 by respective cleaning blades (not shown) so that magnetic brush roll 170 meters fresh toner to the clean donor rolls. As successive electrostatic latent images are developed, the toner particles within the developer material 166 are depleted. A developer dispenser 105, such as those generally described with reference to FIGS. 3–5, stores a supply of toner particles, with or without carrier particles. The dispenser 105 is in communication with reservoir 164 and, as the concentration of toner particles in the developer material is decreased (or as carrier particles are removed from the reservoir as in a "trickle-through" system or in a material purge operation as discussed below), fresh material (toner and/or carrier) is furnished to the developer material 166 in the reservoir. The auger 168 in the reservoir chamber mixes the fresh material with the remaining developer material so that the resultant developer material therein is substantially uniform with the concentration of toner particles being optimized. In this way, a substantially constant amount of toner particles is in the reservoir with the toner particles having a constant charge. Developer housing 164 may also comprise an outlet 195 for removing developer material from the housing in accordance with a developer material purge operation as discussed in detail below. Outlet 195 may further comprise a regulator (not shown) such as an auger or roller to assist in removing material from the housing.

Various sensors and components within developer apparatus 100 are in communication with system controller 90 which monitors and controls the operation of the developer apparatus to maintain the apparatus in an optimal state. In addition to voltage source 190, donor rolls 176 and 178, magnetic brush roll 170, augers 168, dispenser 105 and outlet 195, system controller 90 may, for example, communicate with a variety of sensors, including, for example, sensors to measure toner concentration, toner charge, toner humidity, the voltage bias of the developer material, bias of the magnetic brush roll, and the bias of the donor roll.

Figure 3:
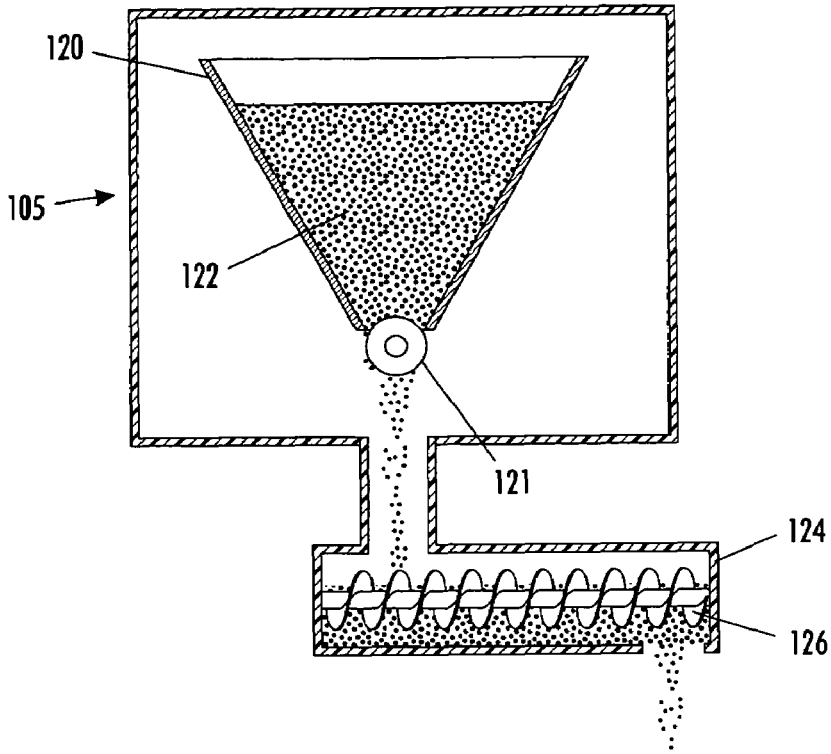
FIGS. 3–5 illustrate various embodiments of a developer material dispenser.

Referring now to FIG. 3, there is shown an embodiment of a developer material dispenser 105. The dispenser 105 includes an open-ended hopper 120 having a dispensing regulator such as foam roller 121 positioned in the open end thereof. A supply of developer material such as toner or replenisher (material comprising a mixture of carrier particles and toner particles), referred to generally as material 122, is stored in hopper 120. As roller 121 rotates, material 122 is discharged from hopper 120 into the developer housing (not shown). Optionally, material 122 dispensed from hopper 120 can be transported to the developer housing through conveyor channel 124 using auger 126 or a similar transfer device such as conveyor belt. The dispensing regulator may be adjusted to control the dispense rate of material 122 from hopper 120.

Figure 4:
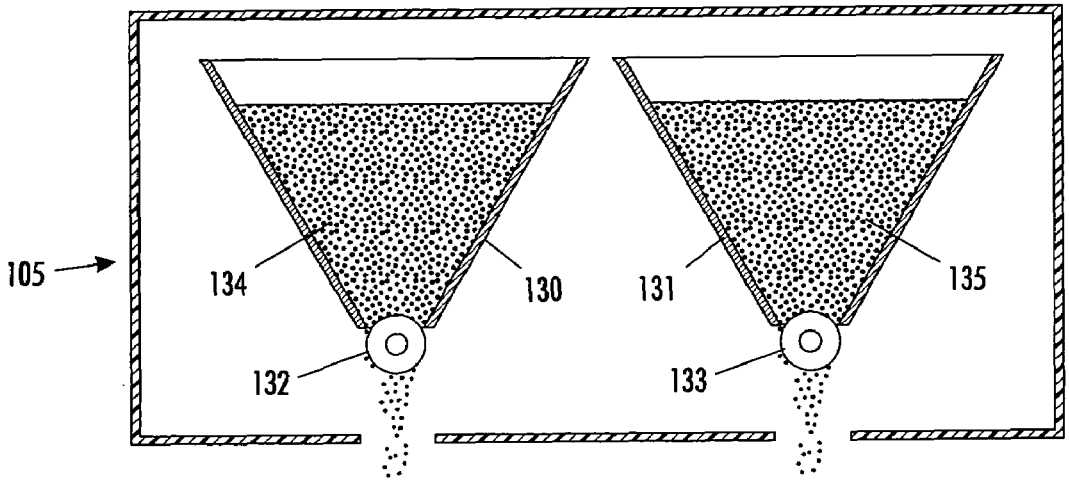

Turning to FIG. 4, there is depicted another embodiment of a dispenser 105. The dispenser 105 includes two open-ended hoppers 130 and 131, each having a dispensing regulator such as a foam roller 132 and 133, respectively, positioned in the open ends thereof. A supply of toner or replenisher material (comprising toner particles or a mixture of carrier particles and toner particles), referred to generally as materials 134 and 135, is stored respectively in hoppers 130 and 131. As rollers 132 and 133 rotate the materials 134 and 135 are discharged from the hoppers 130 and 131 into the developer housing (not shown). The dispensing regulators may be individually adjusted and controlled to regulate the dispense rates of materials 134 and 135 from hoppers 130 and 131.

Figure 5:
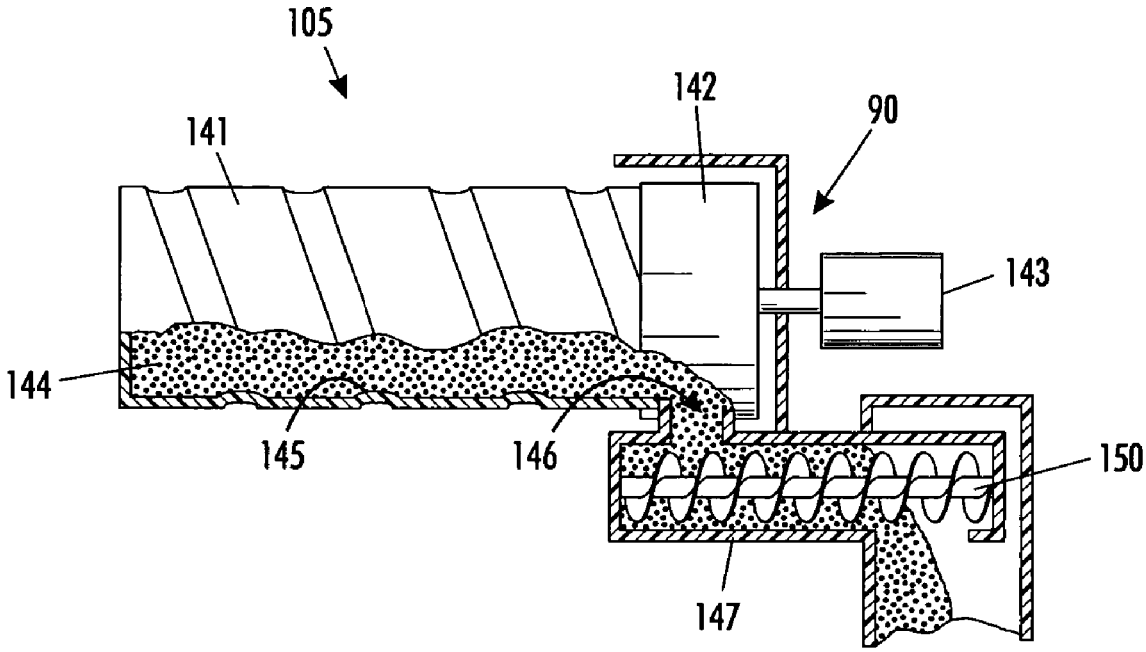

Turning to FIG. 5, there is depicted yet another embodiment of a developer material dispenser 105. Dispenser 105 includes support 142 for holding a toner (or replenisher) container 141 and motor 143 for rotating the container. A spiral ridge 145 is formed on the inner periphery of container 141 such that when motor 143 rotates container 141, the material 144 held within the container is conveyed toward outlet 146 by the spiral ridge 145. The toner conveyed to outlet 146 can be discharged directly into the housing of the development apparatus (not shown). Alternately, the toner can be discharged into conveyor channel 147 which transfers the toner to the housing using auger 150 or a similar transfer device such as conveyor belt.

One skilled in the art will readily appreciate that the dispensing devices discussed above provide a general overview of toner dispensers and that such dispensers may be altered and adjusted as necessary to achieve desired and optimum results.

It has been determined that extended running of developers with excessively low toner throughput results in reduced developability and/or reduced transfer efficiency thereby impairing image quality. Extended running of a developer housing at excessively low toner throughput damages developer material resulting in tribo loss and developer failure. The effect has been found to be related to the mean residence time of the developer materials in the developer housing with materials exceeding a mean residence time becoming aged. Briefly, aged or old developer material is developer material that remains in the development housing after a number of imaging cycles and is thus subjected to prolonged or extended mixing and agitation. With continued agitation in a developer housing the toner becomes impacted on the carrier particles reducing the ability to charge the toner. Additionally, the surface additives on the toner can be knocked off (e.g., transferred to the carrier) or impacted into the toner such that the toner may be changed to a state of little use for its intended purpose. That is, with aged toner characteristics such as the triboelectric charge change from the desired state and thus the toner is not as effective. For example, the toner charge may be too low and cause image background problems. Alternately, when the toner charge becomes too high or assumes an unintended polarity, the toner will not transfer to permit development of the image. Other possible problems with aged toner include: increased susceptibility to RH changes and conditions; loss of all charge; charge changes from negative to positive; admix issues; etc.

Figure 6:
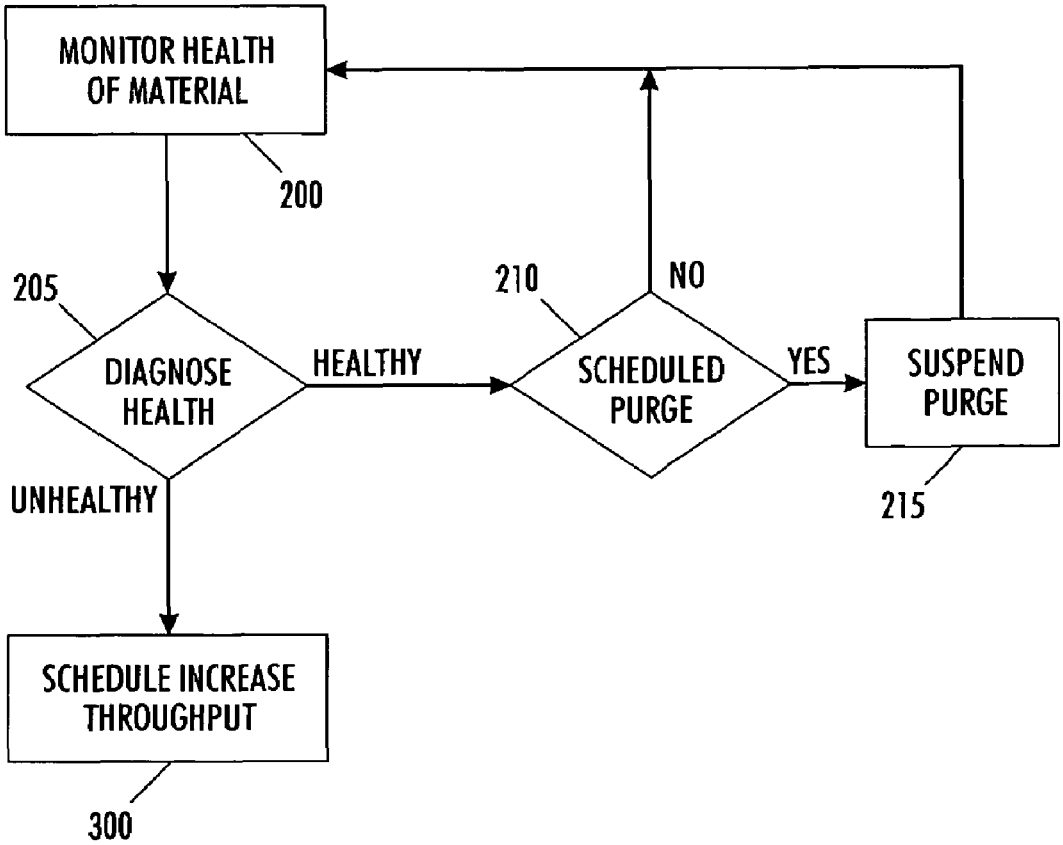
FIG. 6 illustrates an embodiment of a method for maintaining material in a developer housing within a predefined state.

Turning now to FIG. 6, there is shown an embodiment of a method for maintaining material in a developer housing within a predefined state. More particularly, the embodiment of FIG. 6 monitors the "health" of the material in the developer housing. If the material is determined to be "unhealthy", the method schedules an increase in toner throughput via a forced use or removal of the material. The forced increase in toner usage or forced removal and corresponding increase in toner throughput removes unhealthy toner from the developer, leading to an increase in the overall health of the material and thereby maintaining the material state. The scheduled increase in toner throughput can continue, for example, for a prescribed period of time or until a prescribed amount of toner has been used.

At step 200, the method monitors the health of the developer material. In particular, the "health" of developer material may be assessed by one or more of the following factors/characteristics: toner age; toner charge; toner humidity; Toner Concentration (TC) history; bias on the magnetic brush roll, developer roll, or donor roll; bias on the developer electrode wires; developability; transfer efficiency; and Tone Reproduction Curve. Step 200 monitors one or more of the above factors/characteristics providing an assessment of the health of the developer to obtain a measurement or value for such factors/characteristics.

Toner age, the mean residence time in the developer housing, can be directly estimated and monitored by tracking toner throughput. As should be appreciated, toner throughput or toner usage can be tracked by either tracking toner going out of the developer (i.e., the amount of toner used in developing images) or by tracking the amount of toner dispensed into the developer housing (as the developer is in a "steady state" the amount of toner going in is essentially equal to the amount of toner going out).

When directly monitoring the age of developer material by tracking the amount of developer used (going out of the housing), step 200 can estimate toner usage by counting the number of pixels developed in a given period. Given the number of pixels, the amount of toner used to develop the pixels can be calculated. Knowing the amount of toner used in a given period permits a determination of the mean toner age. More specifically, $$\text{Age}(k)=[\text{TonerMass}-\text{TonerOut}]*[\text{Age}(k-1)+\text{Period}]/\text{TonerMass}$$

wherein Period is the elapsed time from the previous determination of toner age;

Age(k−1) is the toner age calculated in the previous determination of toner age;

TonerMass is the average amount (weight) of toner in the developer housing and

TonerOut is the amount of toner used since the previous toner age calculation.

TonnerMass and can be determined as $$\text{TonerMass}=TC*TC\text{Grams}$$

wherein TC is the toner concentration of the developer material in the developer housing (can be obtain from a toner concentration sensor in the housing) and TCGrams is a multiplier identifying the grams of toner per toner concentration unit. TonerOut may be determined according to:

$$TonerOut=PixelCount*DevGain$$

wherein PixelCount is the number of pixels developed in the period (which may be obtained by sampling the signal driving the exposure device or computed from the image data) and DevGain is a gain factor converting pixels to toner weight.

As should be appreciated, the above process can be modified to track the amount of toner dispensed into the housing and substituting this value for the value of toner used (i.e., "TonerOut" in the above equations). The amount of toner dispensed into the developer can be tracked in any number of ways. For example, if each call for or addition of toner provides a uniform volume of material, then simply tracking the number of calls/requests for or additions of toner over a given period provides a direct estimate of the amount of toner dispensed/used in that period. In a dispensing apparatus such as that discussed in FIGS. 3 and 4, the system can track the number of rotations of the dispensing regulator. The number of rotations combined with the volume of material dispensed per rotation provides the volume of material dispensed into the developer housing. Similarly, tracking the number of rotations of the toner container 91 and/or the revolutions of the auger 126 (distance of conveyor belt travel) along with the knowledge of toner volume deposited per rotation, revolution, distance, etc. provides the volume of material dispensed into the developer housing.

Optionally, step 200 may indirectly monitor toner age to determine whether toner is aged. As problems associated with developer aging can appear when printing low area coverage for an extended time, one option to indirectly monitor the age of the developer material tracks average area coverage over a given length of time as images are being printed. For example, if it is determined that toner throughput corresponding to an area coverage of two percent (2%) or less will result in toner exhibiting characteristics of aged toner in 2 hours, then toner age may be step 200 may indirectly monitor toner age by periodically determining the average area coverage over the previous 2 hours of active operation. That is, step 200 can monitor a rolling average area coverage over a given period of time. Although this option can be used to estimate when the developer may be considered old, it does not provide an indication of the developer age at any given moment.

As previously indicated, developability and transfer efficiency characteristics provide an indication of the health of developer material. Thus, step 200 may monitor the developability and/or transfer efficiency to asses the health of developer material. Transfer efficiency can be directly monitored by use of an ETAC sensor mounted to monitor the toner remaining on the belt after transfer (such as ETAC 92 mounted after transfer station 56 and before cleaning station 72 shown in FIG. 1). Similarly, the use of an ETAC sensor mounted to monitor the toner deposited on the belt during development (such as ETAC 94 shown in FIG. 1).

Step 200 may also directly monitor the materials within the developer housing. For example, toner charge and toner humidity can be measured using sensor systems in the developer housing. Furthermore, step 200 may monitor any voltage applied to a magnetic brush roll, developer roll, or donor roll as well as the voltage applied to any developer electrode wires.

System parameters and controls may also be monitored to provide an assessment of toner health. For example, monitoring TC history may provide an indication of and be used to asses the overall health of the developer material. That is, for example, if a system is having difficulties maintaining TC within an defined operational range or if the system experiences abrupt or unexpected changes in TC, the health of the developer material may be in question. Similarly, monitoring the history and state of the TRC may provide an indication of and be used to asses the overall health of the developer material. In particular, monitoring the shape and/or linearity/nonlinearity of the TRC as well as any the state of actuator for controlling TRC can be used to asses the overall health of the developer material.

At step 205, the process uses the measurements for the assessment factors/characteristics monitored in step 200 to determine if the material is healthy. Beneficially, step 205 compares the measurement/values of the assessment factors/characteristics to thresholds to diagnose the health of the developer material. As should be appreciated by those skilled in the art, the threshold for a given factor may differ based upon state of other factors. For example, if the voltage on the magnetic brush roll is near a limit of an operational range, material may be considered unhealthy at a toner age of 100 minutes. On the other hand, if the voltage on the magnetic brush roll is well within the operational range range, the material may be considered unhealthy at a toner age of 120 minutes.

As should be appreciated by those of skill in the art, the selection of the factors to monitor in order to assess the health of the developer material as well as the measure, value or threshold of such factors indicative of the health of the material are a matter of design choice and will be dependent on the materials and operation of the printing machine. Furthermore, the selection of the factors used to assess the health of the developer material as well as the measure, value or threshold thereof can be determined experimentally. For example, by analyzing the developed powder images and transferred images for a given printer/output device generated when the assessment factors or characteristics are at various measurements or values and noting such measurements and values of the assessment factors or characteristics, one may develop sets of assessment factors or characteristics and their measurements or values which define healthy developer material.

If, based on the information obtained from monitoring the health of the developer material at step 200, step 205 determines that the material is unhealthy, the method schedules increased toner throughput at step 300. The increased toner throughput removes unhealthy toner from the developer, leading to an increase in the overall health of the material and thereby maintaining the material state. If step 205 determines that the material is healthy, the process reviews the state of any scheduled increase in toner usage at step 210. If no increased use of toner is scheduled or in process, the method continues to monitor the health of the developer material at step 200. On the other hand, if an increased toner usage has been scheduled or is in progress, the method cancels such increased usage at step 215.

Figure 7:
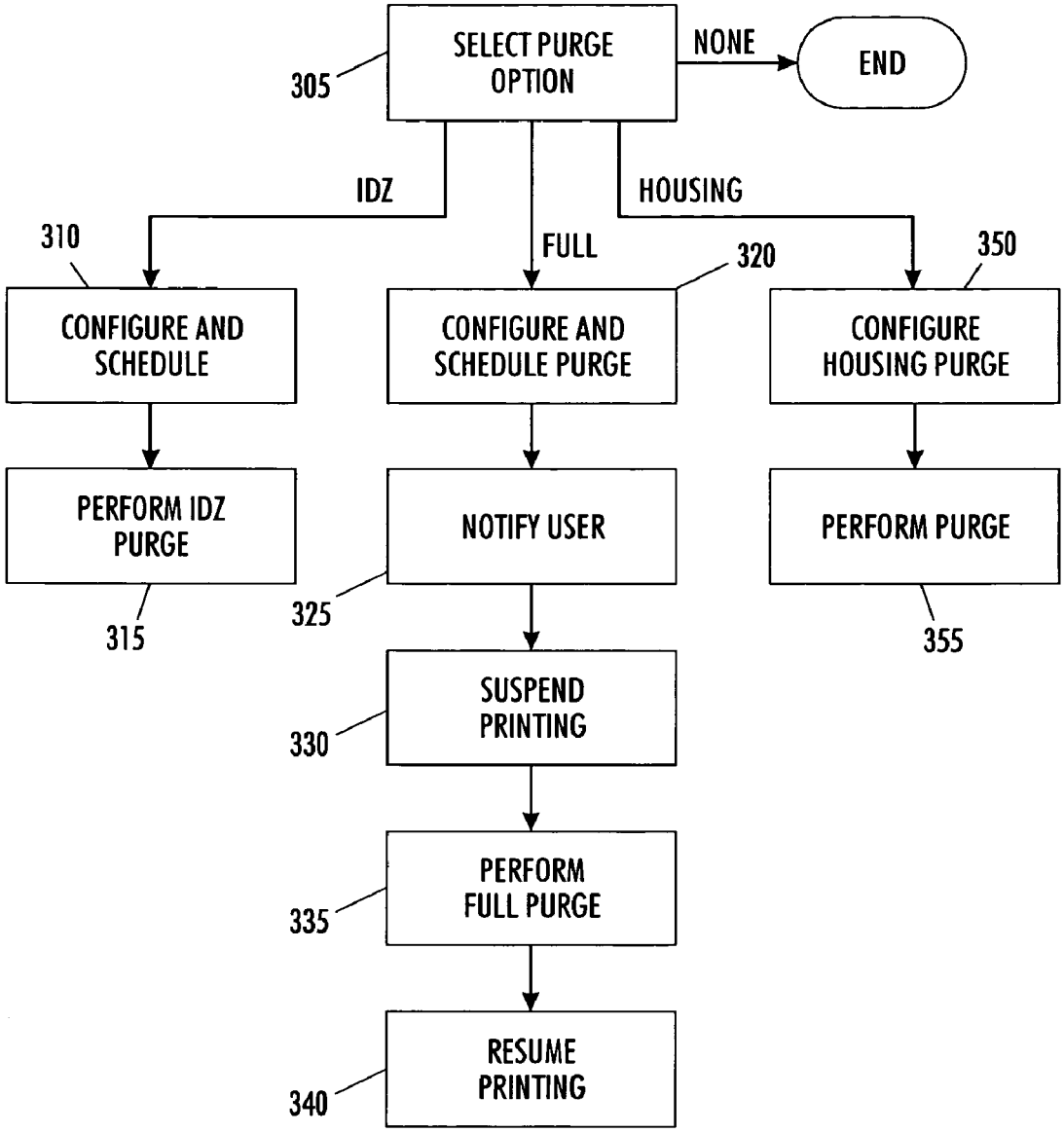
FIG. 7 illustrates an embodiment of a method for scheduling increased toner throughput.

Turning now to FIG. 7, there is shown an embodiment of a method for scheduling increased toner throughput. Briefly, the embodiment of FIG. 7 can provide increased toner throughput by scheduling one or more of three options—housing purge, full purge and IDZ purge—for removing unhealthy material from the developer. Briefly, a housing purge operates to directly remove developer material from the development housing without developing images on the belt/drum by, for example, purging material through an outlet 195 in developer housing. A full purge operates to purge material by suspending printing, developing "purge images" having high area coverage on the belt, and either sending the purge images to the cleaner or transferring the image to a suitable substrate paper which may be discarded. An IDZ purge operates to develop images in "unused" areas of the belt such as in portions of the inter-document zones (IDZs) with the images (toner) being sent to the cleaner.

At step 305, the method selects one of three available purge options: housing purge, full purge and IDZ purge. It should be appreciated that based upon an evaluation of the overall system state, step 305 can opt to override the diagnosis and forego a forced toner purge. The selection of a particular purge option can be based on any number of factors including purge history, upcoming images, relative health of the material, overall printing system state, etc. For example, if the diagnosis provides a relative health such as unhealthy with minimal or no impact on image quality, unhealthy with potential major impact image quality, unhealthy with immediate impact image quality, etc, such diagnosis information may be used to guide a selection. Similarly, the selection may use one or more of the factors monitored in step 205 to guide a selection. For example, the purge option may be based on toner age.

Moreover, the selection may be based on the relative health as between two or more developer units. That is, for example, the selection may be based upon which developer material has a potential impact on image quality. Additionally, if two or more developer units are diagnosed as unhealthy, it may, for example, be more beneficial/efficient to suspend printing and perform a full purge.

Furthermore, purge history can also be used to guide a selection. For example, if the system had recently scheduled several IDZ purges, and the material continues to return to an unhealthy state, the system may select a full purge. Additionally, If information concerning upcoming images to be developed is available, such information may be used to guide a selection as well. For example, if it is known (or estimated) that the average area coverage will increase or decrease in the next set of images such information may be used to guide the selection.

If an IDZ purge has selected, then, at step 310, the method schedules and configures the purge. Briefly reviewing, many electrostatographic printing machines print images within a defined pitch, frame or document zone and periodically develop control patches (e.g., patches for developer control, registration control, etc.) in areas outside or between such defined document zones. An IDZ purge employs unused areas outside the defined document zones to develop IDZ patches. This added toner use leads to an increase in toner throughput, thereby maintaining the material developability by, for example, reducing toner age. As should be appreciated, the amount of toner throughput, and thus the effectiveness of an IDZ purge, will be limited by the available space for developing IDZ patches.

In configuring and scheduling the IDZ purge, step 310 defines the parameters of the purge. Such parameters may include, for example, when to begin or enter the purge routine (e.g., purge should begin at an absolute time, after an elapsed time, after a number of image cycles, after a number of belt or drum revolutions); IDZ patch characteristics such as patch size and toner density; how often an IDZ patch should be developed (e.g., after every image, every other image, every other belt/drum revolution); when to exit the routine (e.g., exit after an elapsed time, a number of revolutions, a number of patches, a given toner usage, a diagnosis of healthy, a defined TC is achieved, etc.); whether a scheduled or running purge can be terminated early, and if so under what conditions; etc. However, it is appreciated that additional or different parameters may also be defined. As with the selection of a purge option, the configuration and scheduling of an IDZ purge may be based upon any number of factors including purge history, upcoming images, relative health of the material, etc. Having configured and scheduled the IDZ purge, step 315 performs the IDZ purge in accordance with the parameters set in step 310.

If, at step 305, the option to perform a full purge is selected, the method continues at step 320 to configure and schedule the purge. Briefly, in a full toner purge, the machine will enter a dead cycle and begin to develop purge images on the belt/drum. These full purge images may be restricted to the defined pitch, frame or document zone area, particularly if they may be transferred to paper. In a single pass machine such as that described in FIG. 1, one may constrain the full purge images to the defined document zones so as to enable the system to perform an IDZ purge and a full purge simultaneously. However, it should be appreciated that full purge images need not be constrained to any predefined areas of the belt/drum.

During a full purge, the toner is generally sent to the cleaner and paper is not fed so as not to incur the cost of the paper and its disposal. However, paper may be fed with the developed purge images being transferred thereto. For example, if the cleaning system cannot keep up with the toner associated with a full purge, the system may reduce the amount of toner going to the cleaner by transferring every $N^{th}$ image to paper. Furthermore, it should be appreciated that, while printing is suspended, the machine can continue to monitor the health of developer material to determine if other stations require purging.

As with step 310, the configuration and scheduling of a full purge defines the parameters of the purge. In addition to the purge parameters discussed above, step 310 may also define parameters specific to full purge option such as, for example, whether paper is to be fed, and if so how often. As with the selection of a purge option, the configuration and scheduling of a full purge may be based upon any number of factors including purge history, upcoming images, relative health of the material, etc.

Having configured and scheduled the full purge, a message is sent to the user through, for example, a machine user interface, a machine controller, a digital front end, etc, that a full purge has been scheduled (step 325) and suspends the current printing, if any, (step 330). After suspending user printing, the machine enters the purge routine in accordance with the parameters set in step 320. After completing the routine, the machine resumes normal operation and resumes printing 340.

If, at step 305, the option to perform a housing purge is selected, the method configures and schedules the housing purge (step 350) and enters the purge routine (step 355). A described above, a housing purge operates to directly remove developer material from the development housing without developing images on the belt/drum by, for example, purging material through an outlet 195 in developer housing.

As with the IDZ purge and full purge operations, the housing purge operation is defined by a set parameters configured in step 350. Such parameters generally include, for example, when to begin or enter the purge routine (e.g., purge should begin at an absolute time, after an elapsed time, after a number of image cycles, after a number of belt or drum revolutions); when to exit the routine (e.g., exit after an elapsed time, a number of revolutions, a number of patches, a given toner usage, a diagnosis of healthy, a defined TC is achieved, etc.); and whether a scheduled or running purge can be terminated early, and if so under what conditions. However, it is appreciated that additional or different parameters may also be defined.

Figure 8:
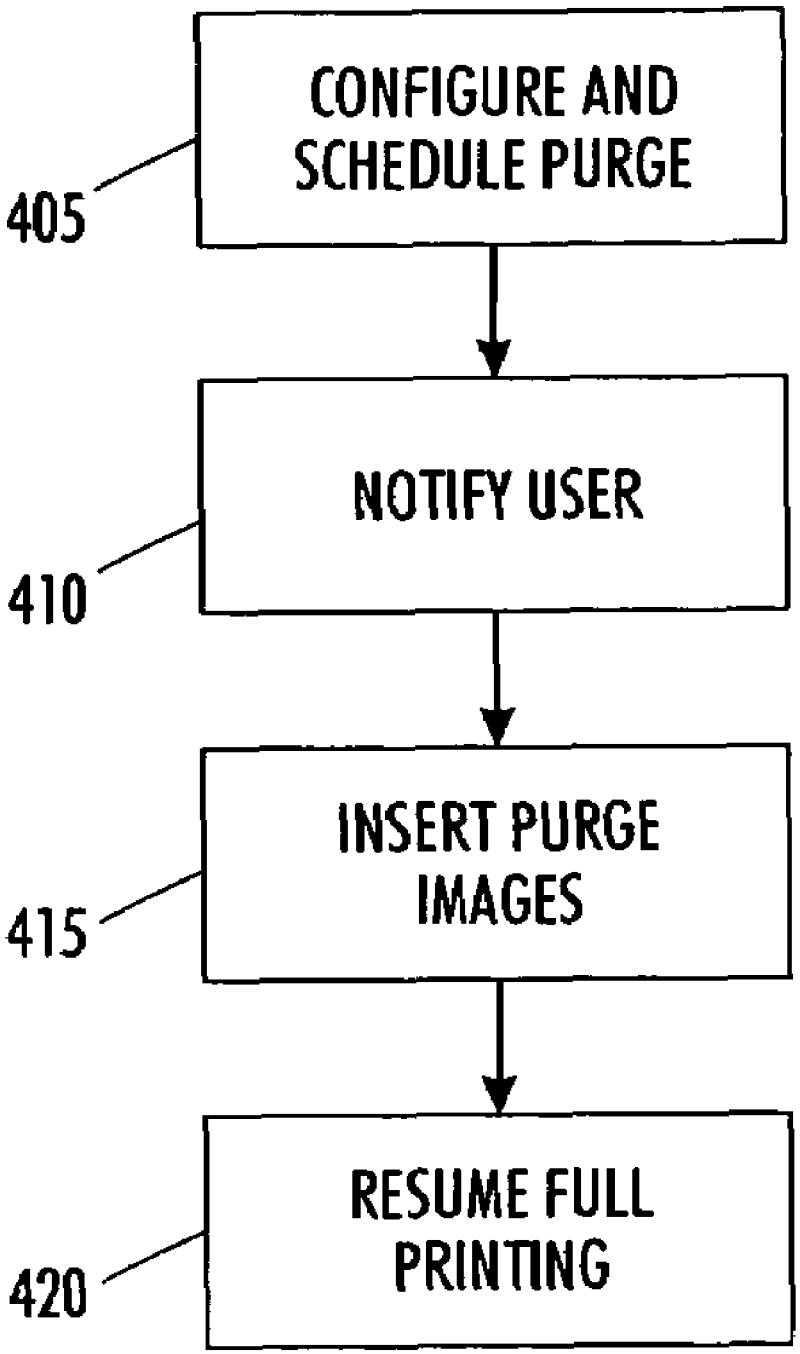
FIG. 8 illustrates an embodiment of a method for scheduling increased toner use.

Turning now to FIG. 8, there is shown another embodiment of a method for scheduling increased toner throughput. Briefly, the embodiment of FIG. 8 provides increased toner throughput by scheduling an image purge option which comprises a modification of the IDZ and full purge options discussed above. In particular, the full purge images are not collected together and printed in a dead cycle. Rather, the machine can periodically delay generating a user's image and insert a high area coverage purge image that is sent to the cleaner between the user's images. By interspersing these purge images throughout the user's job the customer sees continued output (although at a lower rate). This process is similar to the use of skip pitches to allow a toner dispenser to keep up with a high area coverage job. However, rather than the skip pitch remaining undeveloped to effectively reduce the overall toner use, the present disclosure develops a high area coverage to raise the overall toner use.

The method begins with the configuration and scheduling of the image purge option (step 405). It should be appreciated that based upon an evaluation of the overall system state, step 405 can opt to override the diagnosis and forego a forced toner purge. The decision to forego a purge can be based on any number of factors including purge history, upcoming images, relative health of the material, overall printing system state, etc. For example, If information concerning upcoming images to be developed is available, such information may be used to guide a selection as well. That is, if it is known (or estimated) that the average area coverage will increase or decrease in the next set of images such information may be used to guide the selection.

In configuring and scheduling the image purge, step 405 defines the parameters of the purge. Such parameters may include, for example, when to begin or enter the purge routine (e.g., purge should begin at an absolute time, after an elapsed time, after a number of image cycles, after a number of belt or drum revolutions); purge image characteristics such as image size and toner density; how often a purge image should be generated and developed (e.g., inserted between $N^{th}$ image, every other belt/drum revolution); when to exit the routine (e.g., exit after an elapsed time, a number of revolutions, a number of patches, a given toner usage,. a diagnosis of healthy, a defined TC is achieved, etc.); whether a scheduled or running purge can be terminated early, and if so under what conditions; etc. However, it is appreciated that additional or different parameters may also be defined.

Having configured and scheduled the full purge, a message may be sent to the user through, for example, a machine user interface, a machine controller, a digital front end, etc, to indicate that a background system configuration or maintenance has been scheduled (step 410). Next, at step 415, the machine enters the purge routine and inserts purge images in accordance with the parameters derived above. After completing the routine, the machine resumes normal operation and resumes printing 420.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

The invention claimed is:

1. A method for operating a printing machine, comprising:

determining mean residence time of developer material in a developer housing according to:

$$MRT(k)=[TonerMass-TonerUsed]*[MRT(k-1)+Period]/TonerMass$$

wherein MRT(k−1) identifies a previously calculated mean residence time, Period identifies an elapsed time from the determination of mean residence time MRT(k−1), TonerMass identifies an average amount of toner in a developer housing and TonerUsed identifies an amount of toner used since the determination of the previous mean residence time MRT(k−1); and performing a toner purge when the mean residence time exceeds a threshold.

2. The method of claim 1, wherein the step of performing a toner purge comprises:

developing a patch between development of images in response to image data provided by a user; and repeating the developing step for a predetermined period.

3. The method of claim 2, wherein the step of developing a patch between development of images in response to image data provided by a user develops the patch in an area outside document zones defined for developing images in response to the image data provided by the user.

4. The method of claim 1, wherein the step of performing the toner purge comprises:

suspending development of images generated in response to image data provided by a user;

developing an image; and repeating the developing step for a predetermined period.

5. The method of claim 4, further comprising transferring a developed image to a receiving medium.

6. The method of claim 1, wherein the step of performing the toner purge further comprises performing a first toner purge when the mean residence time is between a first threshold value and a second threshold value; and performing a second toner purge when the mean residence time is greater than the second threshold value.

7. The method of claim 1, wherein the step of performing a toner purge comprises:

developing an image to thereby provide increased toner usage; and repeating the developing step until the mean residence time is less than a second threshold.

* * * * *